United States Patent [19]

Khan et al.

[11] 4,280,332

[45] Jul. 28, 1981

[54] DEFROST CONTROL MONITORING FAN MOTOR TEMPERATURE RISE

[75] Inventors: Asadulla R. Khan, Ballwin; Otto H. Boning, St. Louis, both of Mo.

[73] Assignee: Intertherm Inc., St. Louis, Mo.

[21] Appl. No.: 61,707

[22] Filed: Jul. 30, 1979

[51] Int. Cl.[3] ..... F25D 21/06; G08B 21/00

[52] U.S. Cl. ..... 62/156; 340/607; 55/DIG. 34

[58] Field of Search ..... 55/274, 270, DIG. 34; 340/607, 648; 318/472, 473; 62/140, 156, 151, 128

[56] References Cited

U.S. PATENT DOCUMENTS

| | | | |
|---|---|---|---|
| 3,159,980 | 12/1964 | Solley, Jr. | 62/155 |
| 3,273,635 | 9/1966 | Jobes | 165/12 |
| 3,377,817 | 4/1968 | Petrarek | 62/140 |
| 3,397,550 | 8/1968 | Giwosky | 62/158 |
| 3,404,313 | 10/1968 | Happel et al. | 318/473 X |
| 3,466,888 | 9/1969 | Kyle | 62/156 |
| 4,024,722 | 5/1977 | McCarty | 62/156 |
| 4,040,042 | 8/1977 | Mayer | 55/274 X |
| 4,104,888 | 8/1978 | Reedy et al. | 62/80 |

*Primary Examiner*—Albert J. Makay
*Assistant Examiner*—Harry Tanner
*Attorney, Agent, or Firm*—Jerome A. Gross

[57] ABSTRACT

A defrosting control for a heat pump system utilizes a first temperature sensor mounted to the outdoor coil fan motor windings, a second sensor mounted to sense the outdoor ambient air temperature and a third sensor to sense the refrigerant temperature in the outdoor coil. The control circuitry determines the temperature difference of the first two sensors, representing the fan motor temperature rise, which increases dramatically when the outdoor coil is frosted; if the difference exceeds a selected abnormal temperature rise and the temperature sensed by the third sensor indicates frosting is likely to have occurred, the defrost cycle is initiated. The cycle is terminated when the temperature sensed by the third sensor indicates that all frost is likely to have melted.

3 Claims, 2 Drawing Figures

DEFROST CONTROL MONITORING FAN MOTOR TEMPERATURE RISE

BACKGROUND OF THE INVENTION

The field of the present invention is defrosting controls as used in heat pumps.

In utilizing heat pumps for heating, the heat pump outdoor coil must, to take up heat, be at a temperature below the outdoor ambient air temperature. In ordinary operation, the temperature of the coil may be below the outdoor ambient air dew point, causing water vapor to condense on the surface of the coil; if the surface temperature of the coil is below 0° C., frost may appear on the coil. Rainwater may likewise collect on the coil and freeze. To remove the frost, a defrost cycle is initiated, which usually includes de-energizing the outdoor coil fan and reversing the heat pump four-way reversing valve; this causes heat to be transferred from indoor coil to the outdoor coil. As the outdoor coil is heated, the frost melts and the water drains away or evaporates.

In the prior art, various systems have been utilized to control defrosting operation. The simplest systems have a clock which iniiates defrosting at selected time intervals. Other systems, such as disclosed in U.S. Pat. No. 3,466,888 to Kyle, rely on the temperature difference between the outdoor air and the outdoor coil; a difference exceeding a selected level, such as 12° F., indicates frosting. Another system, disclosed in U.S. Pat. No. 4,104,888 to Reedy, et al., initiates defrosting when the compressor current exceeds a selected level; the abnormally high current indicates a frosted outdoor coil. More complicated systems utilize a lamp and photocell to directly detect ice build-up between the coils, or very sensitive pressure transducers to detect pressure drop through the coil resulting from frosting, as shown in U.S. Pat. No. 3,377,817 to Petranek. Each of these systems requires sensitive adjustments in order to operate properly.

SUMMARY OF THE INVENTION

A principal purpose of the present invention is to provide a heat pump defrosting control which initiates and continues defrosting only when positive requirements for defrosting are ascertained, but yet does not require sensitive adjustments.

Briefly summarized, the present invention comprises a first temperature sensor mounted on the outdoor coil fan motor stator windings and a second temperature sensor mounted to sense the outdoor ambient air temperature. Circuitry determines the temperature differential sensed by the two sensors, which may be characterized as the temperature rise of the fan motor, and compares the differential to a selected abnormally high temperature rise. A third sensor, such as a differential thermostat, which senses the outdoor coil refrigerant temperature, enables the circuit at the highest temperature at which frosting may occur and disables the circuit at a temperature indicative that defrosting has been completed. When the temperature rise exceeds the selected abnormal level, indicating probable frost formation causing increased load on the fan motor, and the third sensor indicates a temperature level for which frosting could occur, defrosting is initiated. Defrosting continues until the third sensor senses a temperature at which all frost would be melted.

DESCRIPTION OF THE PREFERRED EMBODIMENT

Figure 1:
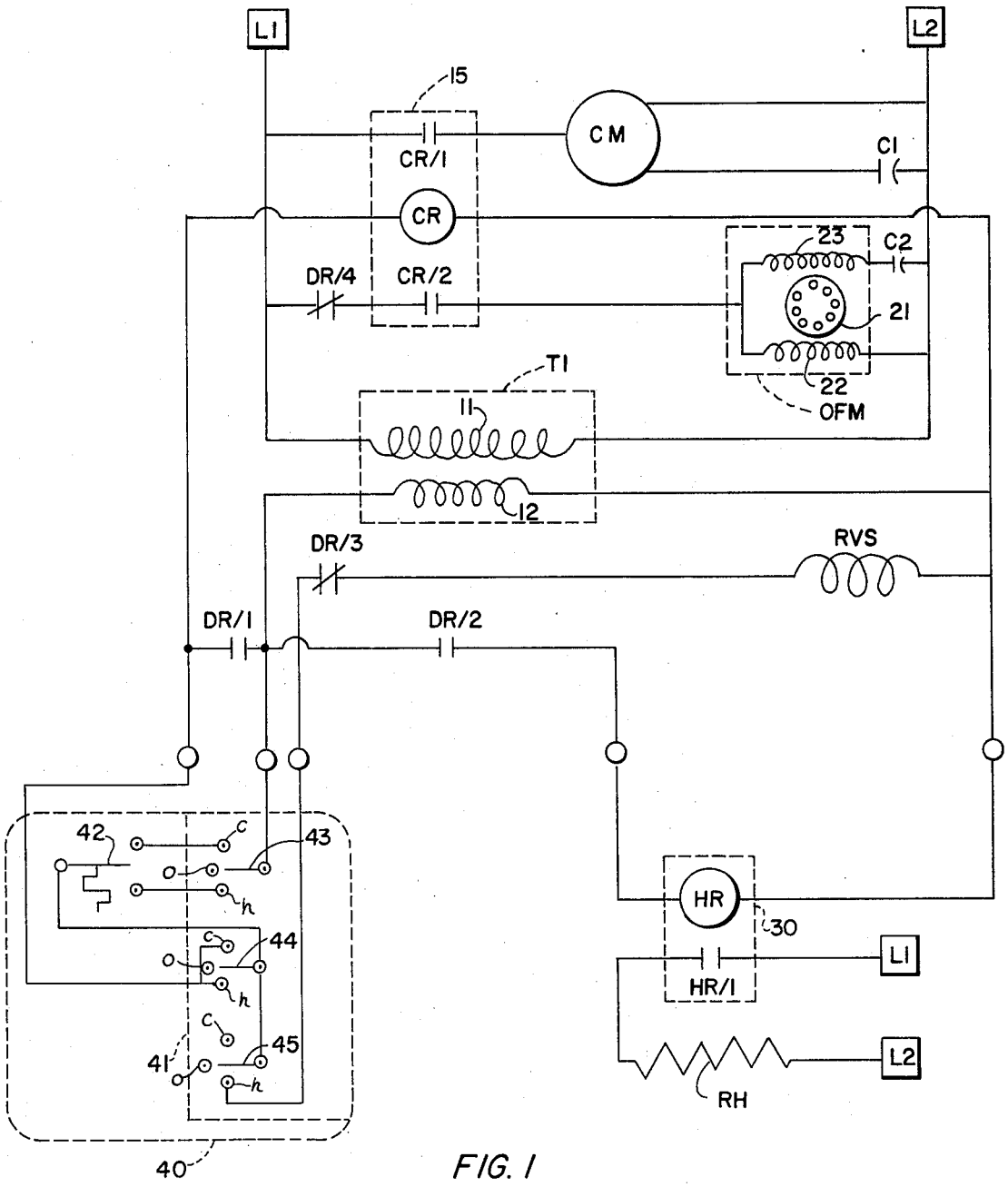
FIG. 1 is a circuit schematic of the basic wiring for a heat pump system.

A typical heat pump system has outdoor and indoor refrigerant coils joined by a pair of refrigerant lines through which refrigerant is circulated by a compressor. Refrigerant flow is reversed for heating and cooling operations by a four-way reversing valve. Air is drawn over the outdoor coil by a fan and likewise over the indoor coil by a blower.

On operation of the heat pump in the heating mode, the outdoor coil picks up heat from the cool outdoor air. The outdoor coil must then be at a temperature lower than that to the outdoor air and may well be below the dew point temperature of the outdoor air, causing water to condense on the coil or, where the temperature of the coil is below the freezing point of water, frost or ice to form on it. Ice may also form on the outdoor coil during winter rains when the temperature of the coil is below the freezing point of water; rainwater which falls on the coil freezes.

The efficiency of the coil is severely diminished by such an accumulation of frost or ice. The ice acts as an insulator, deterring heat transfer from the air to the coil. Build-up of ice between the individual coils prevents air flow through the coil, further decreasing its efficiency.

To defrost, the outdoor coil is heated by transfer of heat energy from indoors: the four-way reversing valve is reversed, so that flow of refrigerant is the same as in the cooling mode, and the outdoor coil fan motor is de-energized, so that a substantial portion of the heat transferred from the indoor coil to the outdoor coil will be utilized to heat up the coil and the ice, rather than being conducted to the outdoor air. Defrosting continues until all the frost has melted and the water drained away or evaporated. Then, for maximum efficiency, the defrost cycle is promptly terminated; the heat pump may then return to the heating mode whenever the thermostat calls for heat.

Described briefly, a preferred defrosting control embodying the present invention, described in detail below, initiates and terminates the defrost cycle in the following manner: a first thermosensor, mounted on the stator of the outdoor coil fan motor, and a second thermosensor, mounted to sense the outdoor air temperature, reflect by the difference in the temperatures they sense, the temperature rise of the fan motor. This temperature rise accurately represents accumulation of frost on the outdoor coil; the frost restricts air flow through the coil, increasing the motor load and decreasing cooling of the motor, causing an abnormally high operating temperature. If the temperature rise exceeds a selected abnormally high level, and the temperature of the refrigerant entering the outdoor coil (sensed by a third thermosensor) is so low as to indicate that conditions are conductive for frosting, the defrost cycle is initiated. Defrosting then continues, even through the temperature of the fan motor drops, until the temperature of the refrigerant exiting from the outdoor coil, sensed by the third thermosensor, is so high as to indicate that all of the frost has been melted.

A detailed description of a preferred embodiment of the defrosting control monitoring outdoor fan motor temperature rise as applied to a conventionally-wired heat pump system follows:

As shown in FIG. 1, power is supplied to the heat pump by a pair of 220-volt power supply lines L1, L2. The primary 11 of a 220/24 V transformer T1 is coupled between L1 and L2; the transformer secondary 12 supplies power for the coils of the various relays, including the relay which initiates the defrosting cycle, referred to as the defrosting relay, whose coil DR is energized by the defrosting control, shown in FIG. 2. The defrost relay has three normally open contacts DR/1, DR/2 and DR/5 and two normally closed contacts DR/3 and DR/4. The secondary 12 of the transformer T1 is in series circuit with the first normally open contact DR/1 of the defrosting relay and with the coil CR of a contactor relay 15, which provides control of the compressor motor CM and outdoor coil fan motor OFM bh its two normally open contacts CR/1 and CR/2. The compressor motor CM is connected to one power supply line L1 by contact CR/1 and to the other power supply line L2 directly and by a starting capacitor C1. One terminal of contact CR/2 is coupled by the normally closed contact DR/4 of the defrosting relay to the one power supply line L1 and its other terminal is connected to the outdoor coil fan motor OFM.

The outdoor coil fan motor OFM in this embodimemt is a fractional horsepower induction motor, shown in schematic form, having a rotor 21, a main winding 22 coupled beween contact CR/2 and the other power supply line L2, and an auxilliary starting winding 23 coupled from contact CR/2 through a series starting capacitor C2 to the second power supply line L2. The maximum recommended temperature rise for this motor is approximately 100° F.

In the indoor section of the heat pump, an auxilliary resistance heater RH is coupled between 220 V supply lines L1 and L2 in series with the normally open contact HR/1 of a resistance heating relay 30. The coil HR of this relay 30 is coupled across the secondary 12 of the transformer T1 in series with the second normally open contact DR/2 of the defrosting relay.

Indoors, the heat pump is provided with a thermostat, generally designated 40, which includes a three-pole, three position selector switch 41 and a cooling/heating thermostatic 42, such as of the bimetal type. The three position switch 41 is utilized to select cooling operation, heating operation, or to turn off the heat pump system, the three switch positions of each switch pole being marked respectively on FIG. 1 with c (cooling), o (off), and h (heating). The pole of the first gang 43 of the selector switch 41 is connected to the common terminals of the transformer secondary 12 and the defrosting coil normally open contacts DR/1, DR/2, to receive 24 V. The thermostatic control 42 is coupled appropriately to the c and h terminals of the first gang 43 of the selector switch 41 and to the poles of the second and third gangs 44, 45 of the selector switch 41. The c and h terminals of the second gang 44 are together connected to the common terminal of the first normally open defrosting coil contact DR/1 and the contactor coil CR. The h terminal of the third gang 45 is coupled through the first normally closed defrosting coil contact DR/3 and a reversing valve solenoid RVS to the transformer secondary 12 at its terminal opposite the terminal connected to the selector switch first pole 43.

Figure 2:
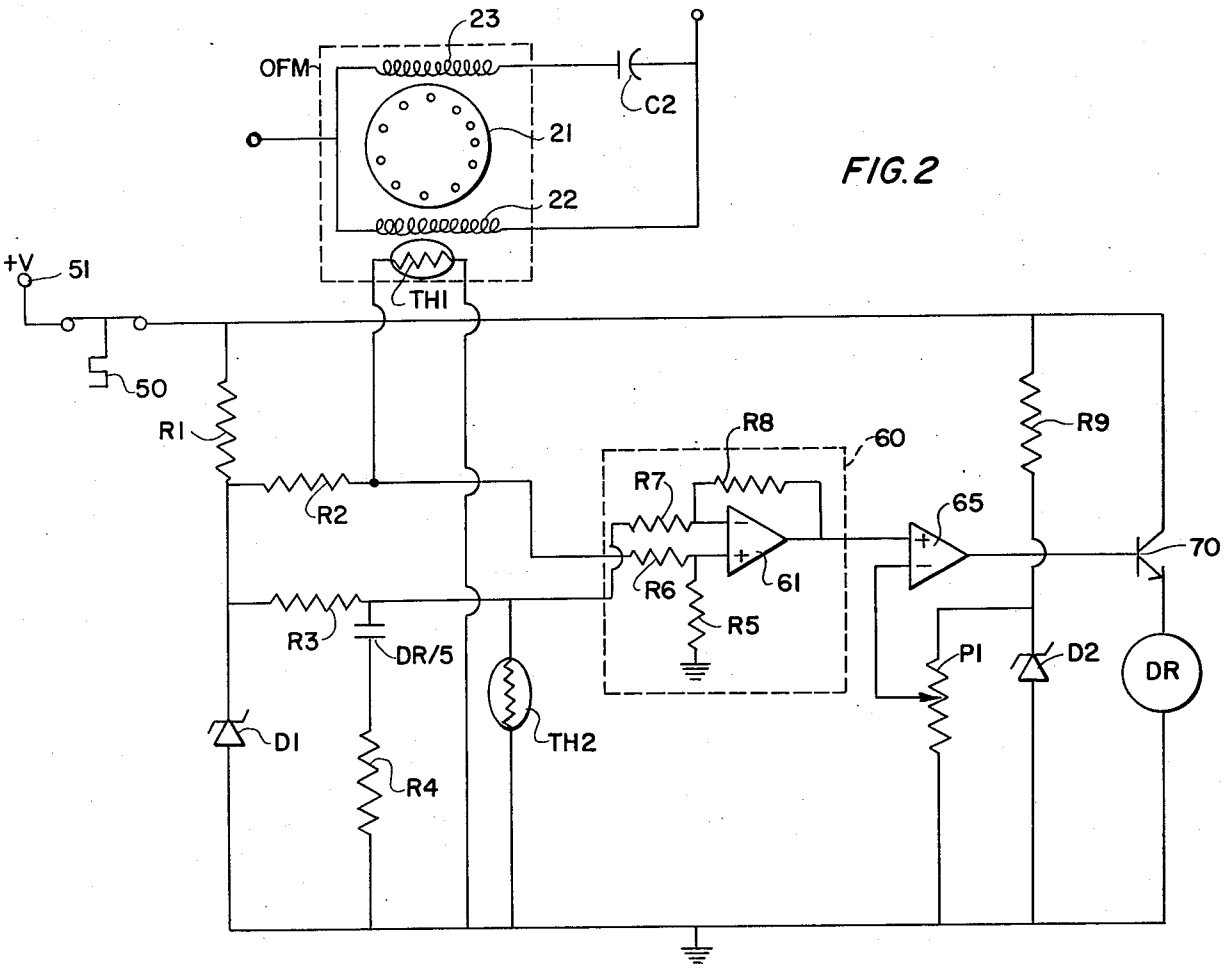
FIG. 2 is a circuit diagram of a preferred embodiment of a defrosting control for use with the system of FIG. 1.

The present novel defrosting control, shown in FIG. 2, serves to energize the defrosting relay coil DR precisely when defrosting is required and to de-energize the coil DR promptly when defrosting is complete. Defrosting is initiated when the outdoor coil fan motor temperature rise exceeds a selected abnormally high level, which is caused by blockage of air flow by frost on the coil.

Describing in detail the embodiment illustrated, a differential bimetal contact thermostat 50, such as of the disc-type or of the snap acting type, couples a voltage supply 51 to the circuit. The differential thermostat 50 is mounted on the tubing inlet to the heat pump outdoor coil inlet for refrigerant flow for the heating mode. The differential thermostat, in this preferred embodiment, opens at approximately 55° F. and after opening remains open until its temperature falls to approximately 30° F. A first thermistor TH1 and a voltage divider resistor R2 are coupled in series from the cathode of the zener diode D1 to the circuit ground. As indicated schematically, the first thermistor TH1 is mounted to or within the stator of the outdoor coil fan motor OFM. Preferably, the thermistor TH1 may be fitted into a bore in the stator, though it may be fixed to either the outer side of or sandwiched between the windings of the main stator winding 22.

A second thermistor TH2 and a second divider resistor R3 are coupled in series from the cathode of the zener diode D1 to ground. This second thermistor TH2 may be mounted on the defrosting control circuit board or any other convenient position in the outdoor air so as to sense the outdoor air ambient temperature. The series combination of a resistor R4 and the third normally open contact DR/5 of the defrosting control relay is in parallel with the second thermistor TH2.

Each of the thermistors utilized in this preferred embodiment are of the positive temperature coefficient type, so that their resistance increases with increasing temperature.

A difference amplifier or subtractor circuit 60, which receives the voltage levels across the first and second thermistors TH1, TH2, includes an operational amplifier or op amp 61 having its non-inverting input coupled to ground by a ground resistor R5 and to the common terminal of the first divider resistor R2 and first thermistor TH1 by a first input resistor R6 and having its inverting input coupled by a second input resistor R7 to the common terminal of the second divider resistor R3 and second thermistor TH2. The output of the op amp 61 is coupled by a feedback resistor R8 to the inverting input.

The output of the subtractor circuit 60, formed by the output of the op amp 61, is coupled to the non-inverting input of a comparator op amp 65. The inverting input of the op amp 65 is coupled to the wiper terminal of a potentiometer P1, which is connected by its remaining two terminals across a second zener diode D2. This diode D2 has its anode to ground and its cathode to a second dropping resistor connected from the terminal of the differential thermostat 50 opposite the voltage supply 51.

The output of the comparator op amp 65 is coupled to the base of a power transistor 70 whose collector is coupled to the terminal of the differential thermostat 50 opposite the voltage supply 51, and whose emitter drives the defrosting relay coil DR.

For operation of the heat pump in the cooling mode, where defrosting need not be performed, the thermostat selector switch 41 is set for cooling by switching to the c (cooling) position. When the thermostatic control 42 calls for cooling by closing the circuit through the terminals of the c position of the selector switch 41, the contactor relay coil CR is energized, closing contacts CR/1 and CR/2 to start the compressor motor CM and fan motor OFM.

On heating operation, the selector switch 41 is switched to the h (heating) position. When the thermostatic control 42 calls for heat, by closing the circuit through the terminals for the h (heating) position, the second gang 44 energizes the contactor relay coil CR, closing the contacts CR/1 and CR/2 to start the compressor motor CM and fan motor OFM. Further, the third gang 45 energizes the reversing valve solenoid RVS, which reverses the position of the four-way valve to cause the required reverse refrigerant flow for heating.

When, during heating operation, the temperature of the refrigerant entering the outdoor coil falls below 30° F., at which frosting may begin to occur, the differential thermostat 50 is closed, energizing the defrost control circuit. If frost collects on the outdoor coil, the load on the outdoor coil fan motor OFM increases due to restriction of the air flow between the individual cores of the outdoor coil. This increased load causes increased losses and heating in the motor windings; the restriction of air flow further decreases cooling of the motor OFM. The temperature of the stator main winding 22 increases and is reflected by the first thermistor TH1, whose resistance increases. Utilizing the circuitry described, the voltage drop across the thermistor TH1 then increases. Since the second thermistor TH2 is exposed to the outdoor ambient air, its voltage level reflects the outdoor air temperature, in the same proportion as the first thermistor TH1. The subtractor circuit 60 receives these two inputs and produces a voltage level at its output which reflects the difference between the two voltage levels as a positive voltage level which indicates the temperature rise of the fan motor OFM. The normal temperature rise for a motor of this type is generally about 70° F.; the maximum recommended being about 100° F. By adjusting potentiometer P1 to produce the proper voltage level, the op amp comparator 65 is made to produce a digital high output only when the output from the difference amplifier circuit 60 to its non-inverting input represents a temperature difference greater than approximately 70° F. Otherwise the comparator 65 produces no output, a digital low. A high output of the comparator 65 causes the transistor 70 to conduct, energizing the defrost relay coil DR.

The resulting closing of the first normally open defrost relay contact DR/1 causes the contactor relay coil CR to remain energized during the defrost cycle so that the compressor continues to run. The outdoor coil fan motor OFM would likewise be energized but for the opening of the second normally closed defrost relay contact DR/4. Opening of the first normally closed defrosting relay contact DR/3 releases the reversing valve solenoid RVS, causing refrigerant flow as for cooling mode operation. The resulting refrigerant flow transfers heat from the indoor to the outdoor coil, causing the accumulated ice to melt and the resulting water to evaporate or drain away. To compensate for the loss of heat indoors during defrosting, the second normally open defrost relay contact DR/2 closes, energizing the resistance heating relay coil HR, closing its normally open contacts HR/1 to supply current to the resistance heater RH.

Closing of the third normally open contact DR/5 switches the resistance R4 in parallel with the second thermistor TH2, lowering the voltage level at the inverting input of the subtractor circuit op amp 61, increasing the output level of the op amp 61. This essentially provides a temperature differential for the sensing of motor temperature rise. The temperature sensed by the first thermistor TH1 may drop after the motor is de-energized, and the voltage at the output of the subtractor op amp 61 will also then fall, but the voltage level, increased by switching in of the parallel resistance, will not fall so low that the comparator op amp 65 will go low.

Because of the reversal of refrigerant flow during the defrosting cycle, the refrigerant sensed by the differential thermostat 50 is that leaving the outdoor coil. The refrigerant temperature at that point remains quite low until all of the frost has been removed from the coils; then the refrigerant temperature in the coil will begin to rise rapidly. When it exceeds the 55° F. level, the differential thermostat 50 opens removing the voltage supply for the power transistor 70 and therefore de-energizing the defrosting relay coil DR. The defrosting relay contacts DR/1–DR/5 then return to their normal positions, permitting the fan motor OFM to turn on and turning off the resistance heater element RH. Control of the system is then returned to the thermostat 40.

Construction of the apparatus is by conventional techniques. The defrosting control shown in FIG. 2 may be mounted on the printed circuit board, except for the first thermistor TH1 mounted on the motor winding 22, the differential thermostat 50 mounted on the tubing leading to the outdoor coil to sense the refrigerant temperature, and the defrosting relay whose coil DR is driven by the transistor 70.

The advantages of the present defrosting control are numerous. Selection of the temperature rise of the fan motor as the parameter indicating defrosting is required is particularly advantageous because the increase in motor temperature rise is so great that the circuitry for determining the temperature rise and comparing it to a selected abnormal rise need not be highly sensitive, unlike prior defrosting controls.

Modifications of the above described preferred embodiment will be apparent to persons skilled in the art. Other means to measure the temperature rise of the outdoor coil fan motor may be utilized, including other temperature sensors, such as strips whose resistivity is a function of temperature fitted in the stator slots during winding. Other means to compare the measured temperature rise to a selected abnormal fan motor temperature rise may be utilized, as well as other switch means, responsive to the comparison, to initiate defrosting when the measured temperature rise exceeds the selected abnormal. Likewise, other means may be employed to sense a condition not conducive to frosting and on so sensing to avoid initiation of defrosting. Where the thermal mass of the outdoor coil fan motor is so great that its temperature will not fall appreciably after it is de-energized on initiation of defrosting, use of the parallel resistance, which essentially provides a temperature differential, may not be required. Other operating parameters of the outdoor coil fan motor may be sensed; switch means may be utilized to initiate defrosting when the operating parameter so far departs from normal that its value corresponds to a frosted condition of the outdoor coil. From these examples, other modifications will suggest themselves.

We claim:

1. A heat pump system defrosting control of the type which causes reversal of refrigerant flow and de-energizes the outdoor coil fan electric motor upon initiation of defrosting, comprising a first temperature sensor mounted to the outdoor coil fan electric motor and sensing the fan motor temperature, a second temperature sensor so mounted as to sense the outdoor ambient air temperature, means, responsive to the first and second temperature sensors, to measure the difference in the temperatures sensed by the two sensors, whereby the difference represents the temperature rise of the fan motor, means to compare such measured temperature difference to a selected abnormal fan motor temperature rise, switch means, responsive to the comparison, to initiate such defrosting and so de-energize the outdoor coil fan motor when the temperature difference exceeds the said selected abnormal temperature rise, and means, controlling defrosting, to sense the outdoor coil temperature and permit initiation of such defrosting if a pre-selected low coil temperature has been reached and to terminate defrosting when a pre-selected high coil temperature has been reached.

2. The defrosting control defined in claim 1, wherein the first temperature sensor is mounted to the stator of the fan electric motor.

3. A heat pump system defrosting control as defined in claim 1, together with circuit means, effective on such de-energizing of the outdoor coil fan motor, to so affect the sensing of said ambient outdoor temperature as to augment the difference in temperatures sensed, whereby to offset any drop in temperature differential which may follow de-energization of the fan motor and thereby avoid premature termination of defrosting.

* * * * *

UNITED STATES PATENT AND TRADEMARK OFFICE

CERTIFICATE OF CORRECTION

PATENT NO. : 4,280,332

DATED : July 28, 1981

INVENTOR(S) : Asadulla R. Khan; Otto H. Boning

It is certified that error appears in the above—identified patent and that said Letters Patent is hereby corrected as shown below:

Column 1, line 25, delete "iniiates" and substitute ---initiates---;

Column 2, line 63, delete "conductive" and substitute ---conducive---;

Column 2, line 64, delete "through" and substitute ---though---;

Column 3, line 20, delete "bh" and substitute ---by---;

Column 3, line 30, delete "embodimemt" and substitute ---embodiment---;

Column 3, line 48, after "thermostatic" add ---control---.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*